US009453512B2

(12) United States Patent
Tadokoro et al.

(10) Patent No.: US 9,453,512 B2
(45) Date of Patent: Sep. 27, 2016

(54) CROSS FLOW FAN, AIR-SENDING DEVICE, AND AIR-CONDITIONING APPARATUS

(75) Inventors: Takahide Tadokoro, Tokyo (JP); Takashi Ikeda, Tokyo (JP); Seiji Hirakawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 604 days.

(21) Appl. No.: 14/003,279

(22) PCT Filed: Mar. 11, 2011

(86) PCT No.: PCT/JP2011/055771
§ 371 (c)(1),
(2), (4) Date: Sep. 5, 2013

(87) PCT Pub. No.: WO2012/124021
PCT Pub. Date: Sep. 20, 2012

(65) Prior Publication Data
US 2013/0336788 A1 Dec. 19, 2013

(51) Int. Cl.
*F04D 17/04* (2006.01)
*F04D 29/30* (2006.01)

(52) U.S. Cl.
CPC ..... *F04D 17/04* (2013.01); *F04D 29/30* (2013.01)

(58) Field of Classification Search
CPC .... F04D 29/28; F04D 29/281; F04D 29/282; F04D 29/283; F04D 29/30
See application file for complete search history.

(56) References Cited

U.S. PATENT DOCUMENTS 9,039,347 B2 * 5/2015 Tadokoro ..... F04D 17/04 415/53.1

FOREIGN PATENT DOCUMENTS

| | | | |
|---|---|---|---|
| JP | 03-194196 | A | 8/1991 |
| JP | 08-1320 | U | 8/1996 |
| JP | 09-100795 | A | 4/1997 |
| JP | 10-077988 | A | 3/1998 |
| JP | 2001-050189 | A | 2/2001 |
| JP | 2006-329099 | A | 12/2006 |
| JP | 2008-261311 | A | 10/2008 |
| JP | 2009-293616 | A | 12/2009 |
| WO | 2006/035933 | A1 | 4/2006 |

OTHER PUBLICATIONS

Office Action mailed Jun. 1, 2015 in the corresponding CN application No. 201180069194.5 (with English translation).

(Continued)

*Primary Examiner* — Nathaniel Wiehe
*Assistant Examiner* — Cameron Corday
(74) *Attorney, Agent, or Firm* — Posz Law Group, PLC

(57) ABSTRACT

A cross flow fan achieves low power input and low noise level by preventing flow separation on an air inlet side and reducing a maximum air velocity in the gap between the blades. At least one of units constituting a cross flow fan is an appearance unit configured such that when the unit is sequentially cut in a direction from one of rings to the other ring along a plane whose normal coincides with a rotation axis, a region S and a region C appear, the radius of a second circle, serving as an inner circumferencial circle (having a radius), in the region S being a first radius of predetermined length, the radius of the second circle, serving as the inner circumferencial circle, in the region C being a second radius shorter than the first radius.

11 Claims, 16 Drawing Sheets

(56) References Cited

OTHER PUBLICATIONS

Japanese Office Action dated Nov. 17, 2011 issued from the Japanese Patent Office in the corresponding Japanese patent application No. 2009-255644 (English translation attached).
Japanese Office Action dated Feb. 7, 2012 issued from the Japanese Patent Office in the corresponding Japanese patent application No. 2009-255644 (English translation attached).
Japanese Office Action dated Jul. 2, 2013 issued from the Japanese Patent Office in the corresponding Japanese patent application No. 2012-003930 (English translation attached).

International Search Report of the International Searching Authority mailed Jun. 14, 2011 for the corresponding international application No. PCT/JP2011/055771 (with English translation).

* cited by examiner (b) LOWER UNIT PART (a) FAN CENTRAL-AXIS LEVEL (a)

(b)

CROSS FLOW FAN, AIR-SENDING DEVICE, AND AIR-CONDITIONING APPARATUS

CROSS REFERENCE TO RELATED APPLICATION

This application is a U.S. national stage application of PCT/JP2011/055771 filed on Mar. 11, 2011, the disclosure of which is incorporated herein by reference.

TECHNICAL FIELD

The present invention relates to a cross flow fan included in, for example, an indoor unit of an air-conditioning apparatus, an air-sending device including the same, and an air-conditioning apparatus including the same.

BACKGROUND

In recent air-sending devices and air-conditioning apparatuses, required capacity for use in large rooms has been increased. Accordingly, the air-sending devices are required a high rate of air flow. Furthermore, the air-sending devices and the air-conditioning apparatuses are required to be low power input and low noise level for energy saving and increased comfort. In some cases, the above requirements are satisfied by devising the shape of blades of fans.

Case (1) Noise reduction by matching a direction in which air flows into the gap between blades to an inlet angle of each blade (refer to Patent Literature 1, for example)

Case (2) Timing delay in occurrence of noise achieved by variation in outer diameter of a fan along the width direction of the fan (refer to Patent Literature 2 and Patent Literature 3, for example)

Case (3) Uniform air velocity distribution in an axial direction of an impeller achieved by varying the chord length in the axial direction of the impeller (refer to Patent Literature 4, for example)

PATENT LITERATURE

Patent Literature 1: Japanese Unexamined Patent Application Publication No. 2006-329099 (p. 7, FIG. 1)

Patent Literature 2: Japanese Unexamined Patent Application Publication No. 9-100795 (p. 6, FIG. 2)

Patent Literature 3: Japanese Unexamined Patent Application Publication No. 2001-50189 (p. 4, FIGS. 1 and 3)

Patent Literature 4: Japanese Unexamined Patent Application Publication No. 10-77988 (p. 6, FIG. 4)

In a related-art cross flow fan, blades have the same shape in cross-section in the width direction of the fan, therefore in the outlet part of the cascade of blades, the orientations of the cascade blades match a direction in which air flows into the cascade of blades at the same position in the width direction of the fan. Disadvantageously, the velocity of air flowing through the gap between the blades is locally increased. Energy loss during passing through the gap between the blades is proportional to the square of air velocity and noise is proportional to the power of six of air velocity. Accordingly, thus-increased air velocity causes deterioration of input power and increased noise of the fan. Furthermore, since high velocity main flow locally remains in an air passage after the fan blows air, a vortex is generated due to the difference in velocity and thus increasing energy loss. In addition, the high velocity flow collides against an air flow control vane disposed at an air outlet, to cause considerable pressure fluctuations, leading to increased noise. As disclosed in Patent Literature 1, by varying the outlet angle on the periphery of the fan in the width direction of the fan, ventilation resistance in a cascade of blades is controlled using large and small angles, so that air blowing positions can be changed. If the outlet angle is too large, however, air may fail to flow along blades on an air inlet side of the cascade of blades, thus causing a phenomenon, called flow separation, in which a vortex occurs at an edge of a blade. This leads to increased energy loss and noise. It is therefore difficult to achieve a wide range of blown air distribution by control only on the periphery of the fan.

As disclosed in Patent Literature 2 and Patent Literature 3, by varying outer diameter of the fan, air velocity can be varied using long and short chord lengths, thus uniformizing the air velocity distribution in the air passage. Since the orientation of the edge of each blade in the cascade of blades on the air inlet side varies depending on the diameter of the fan, however, air flows along the blades at some positions and large flow separation occurs at other positions. It is therefore difficult to reduce energy loss and noise in an air-sending device as a whole. Furthermore, since the fan is not aligned with a sealing position of a stabilizer (nose) in the width direction of the fan, flow leakage may occur to reduce the rate of blown air. In addition, an increase in diameter of the fan may increase vibrations if the blades have an uneven thickness due to production tolerance.

As disclosed in Patent Literature 4, by varying the chord length in the axial direction, although the air velocity distribution in the axial direction of the impeller may be uniformized, it may be difficult to provide uniform air blowing in a circumferential direction of the impeller. To achieve uniform air blowing in the circumferential direction of the impeller, each blade has to be shaped so as to have a clear difference in the rotational axis direction. As illustrated in FIG. 4 of Patent Literature 4, with a blade having a shape that gradually varies, the blown air flow may be concentrated to specific cascade of blades in the same way as in two-dimensional blades having the same cross-section in the axial direction.

SUMMARY

This invention intends to achieve low power input and low noise level in a fan by changing air blowing positions of the fan to reduce a maximum velocity of air flowing through the gap between the blades while preventing flow separation on an air inlet side. Furthermore, the invention provides an air-sending device or air-conditioning apparatus that exhibits reduced energy loss and reduced noise in an air passage achieved by uniformizing the velocity distribution of air blown from a fan in the air passage.

The invention provides a cross flow fan including at least two ring-shaped blade supporting members arranged at a predetermined distance from each other in a longitudinal direction of a rotation axis of the cross flow fan, and a plurality of blades arranged between the two adjacent blade supporting members such that the blades are positioned adjacent to a periphery of the cross flow fan and are arranged at intervals in a circumferential direction thereof. The cross flow fan includes at least one unit composed of the blades arranged between the two adjacent blade supporting members. The at least one unit is configured such that when the unit is cut at any position between the two blade supporting members along a plane whose normal coincides with the rotation axis, cross-sections of the blades each having a first end and a second end appear, the first end being remote from an intersection of the rotation axis and the plane, the second end being close to the intersection. The first ends of the cross-sections of the blades remote from the intersection are aligned on a circumference of a first circle whose center coincides with the intersection on the plane and the second ends thereof close to the intersection are aligned on the circumference of a second circle whose center coincides with the intersection on the plane. The cross-sections of the blades are arranged between the first circle that serves as an outer circumferencial circle and a second circle that serves as an inner circumferencial circle. The at least one unit is at least one appearance unit configured such that when the appearance unit is sequentially cut in a direction from one of the blade supporting members to the other blade supporting member along the plane, a first radius region and a second radius region appear, the radius of the second circle, serving as the inner circumferencial circle, in the first radius region being a first radius of predetermined length, the radius of the second circle, serving as the inner circumferencial circle, in the second radius region being a second radius shorter than the first radius.

The invention provides a cross flow fan with low power input and low noise level.

DESCRIPTION OF EMBODIMENTS

Embodiment 1

Figure 1:
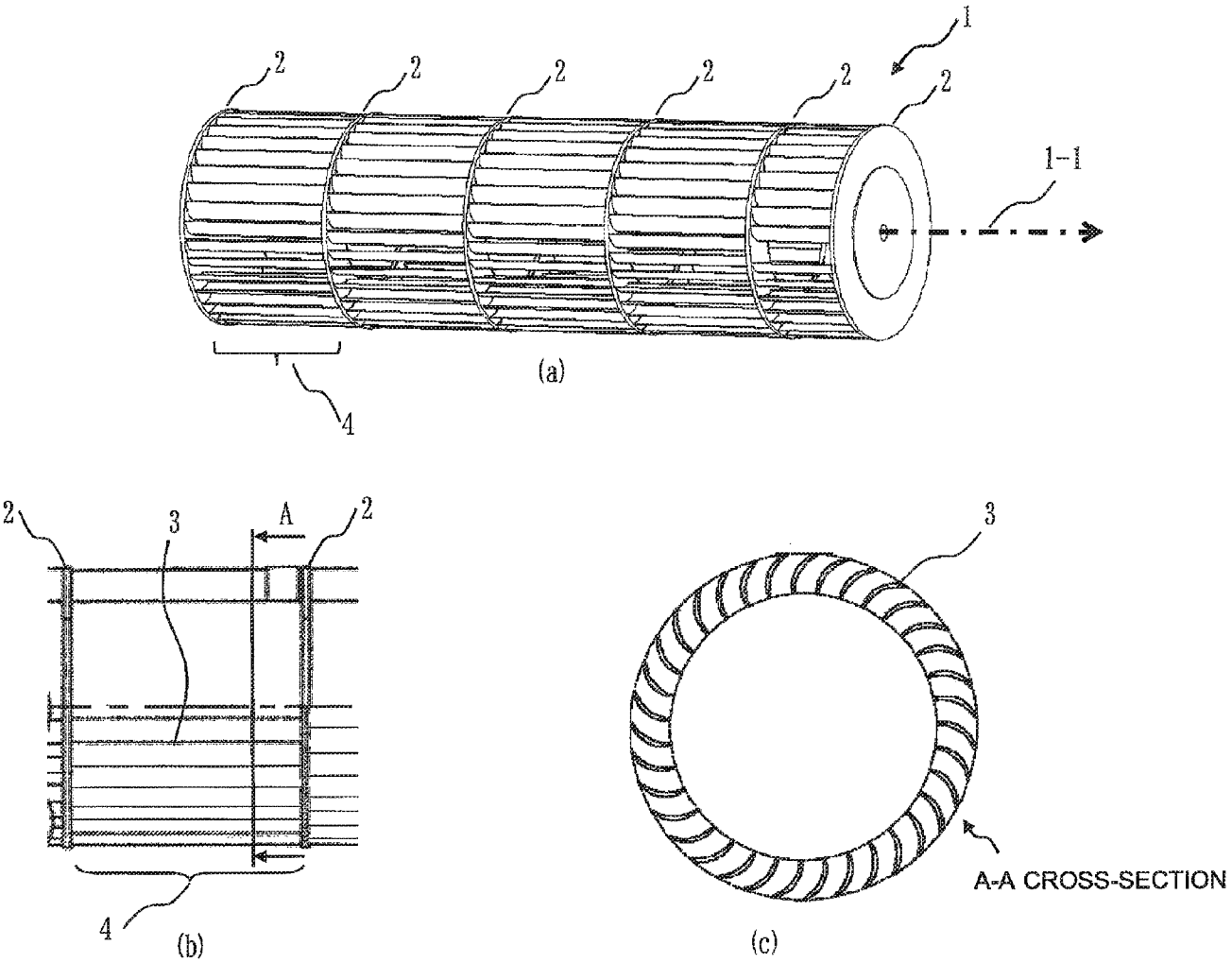
FIG. 1 includes views illustrating a configuration of a cross flow fan 1 according to Embodiment 1.

A cross flow fan 1 according to Embodiment 1 will be described with reference to FIGS. 1 to 9. FIG. 1 includes views illustrating a configuration of the cross flow fan 1 according to Embodiment 1. FIG. 1(*a*) is a perspective view illustrating an appearance of the cross flow fan 1. FIG. 1(*b*) is an enlarged view of part between rings 2.

FIG. 1(*c*) is a cross-sectional view taken along line A-A in FIG. 1(*b*).

The cross flow fan 1 includes a plurality of ring-shaped blade supports (hereinafter, referred to as "rings") (FIG. 1(*a*)) arranged at predetermined distances in a longitudinal direction along a rotation axis 1-1 and a plurality of blades (FIG. 1(*c*)) arranged between the two adjacent rings 2 such that the blades are positioned adjacent to the periphery of the cross flow fan 1 and are arranged at intervals in a circumferential direction of the fan. Referring to FIG. 1(*a*), the cross flow fan 1 includes six rings 2 and thirty five blades 3 are arranged between the two adjacent rings. In FIG. 1(*a*), a component composed of the blades attached between the two adjacent rings will be referred to as an "impeller unit 4" (or "set"). In FIG. 1(*a*), the cross flow fan 1 includes five "sets" (units).

(Cross-Sectional Shape of Blade of Cross Flow Fan 1)

Figure 2:
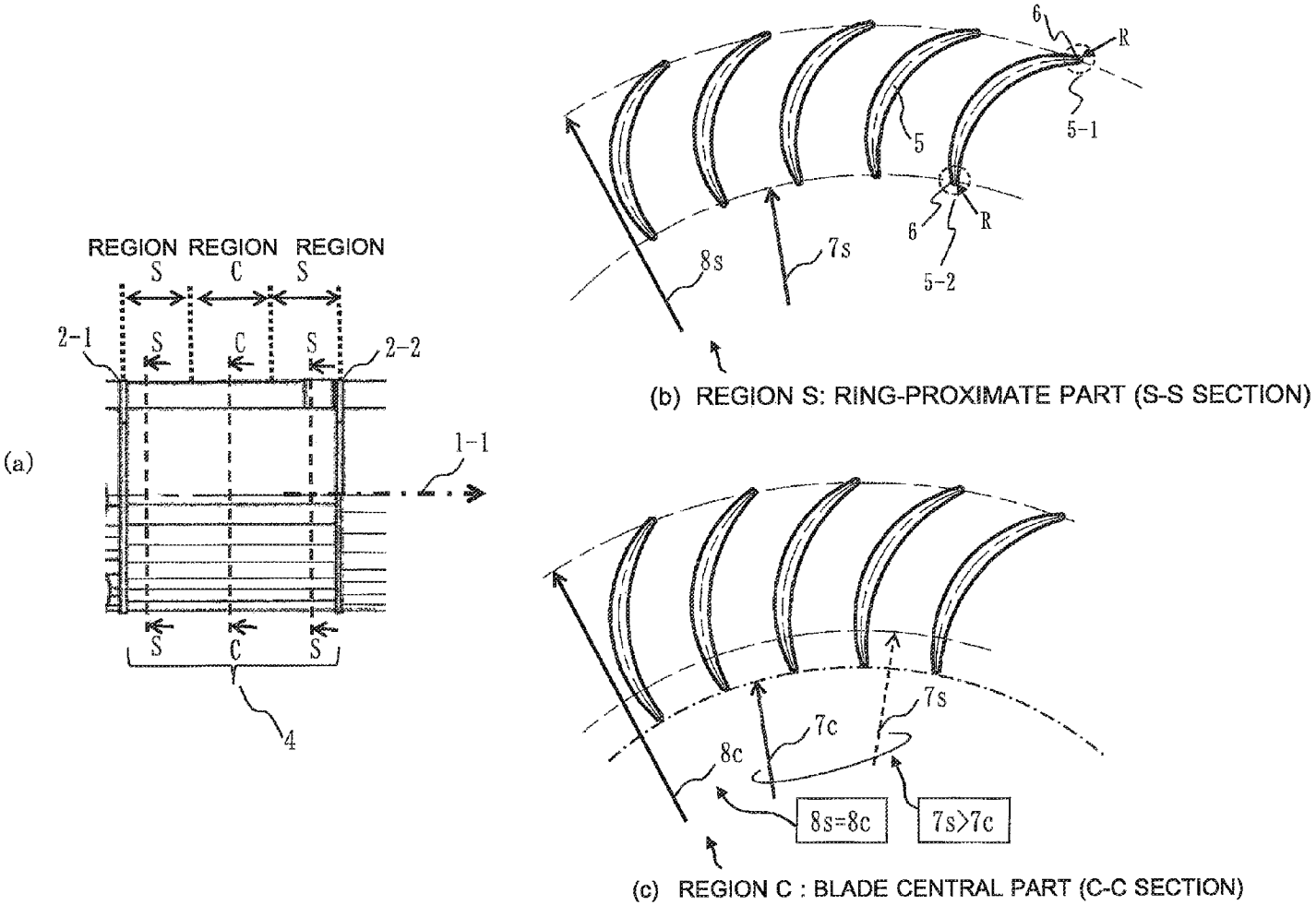
FIG. 2 includes an external view and sectional views of the cross flow fan 1 according to Embodiment 1.

FIG. 2 includes views illustrating the sectional shape and appearance of the cross flow fan 1. FIG. 2(*a*) is a view similar to FIG. 1(*b*). FIG. 2(*b*) is a sectional view taken along line S-S. FIG. 2(*c*) is a sectional view taken along line C-C. As illustrated in FIG. 2(*a*), a portion between a ring 2-1 and a ring 2-2 in the set is divided into three regions each having a given width such that a region S (Side) which serves as a left region, a region C (Center) which serves as a central region, and a region S which serves as a right region are arranged in the order from the left. The reason why the left and right regions are the regions S is that the cross-sectional shape of left part of each blade is the same as that of right part thereof as described later. The three regions each have a width that is one third the width of the set in FIG. 2. The cross-sectional shape of the blade is varied in the region S, the region C, and the region S as described below.

In the following description, the region S proximate to the ring 2 may be referred to as "ring-proximate part" and the region C in the central part of the blade may be referred to as "blade central part".

The cross-sectional shape of the blade in the ring-proximate part (region S) and that in the blade central part (region C) will be compared. In FIG. 2(*b*) that illustrates a section taken along line S-S and FIG. 2(*c*) that illustrates a section taken along line C-C, a line (blade center line 5) extending along the center of the thickness of the blade is an arc. Circles (a first circle having an outer diameter 8 and a second circle having an inner diameter 7 which will be described later) are defined, each circle extending through the centers of curvature, or the curvature centers 6 of rounded blade edges (or sharp edges in cases where the edges are not rounded). Specifically, as illustrated in FIGS. 2(*b*) and (*c*), when the set is cut at any position between the two rings along a plane whose normal coincides with the rotation axis 1-1, the cross-sections of the blades each having a first end 5-1 and a second end 5-2 appear, the first end 5-1 being remote from the intersection (point P, serving as the center of the circle, in FIG. 3) of the rotation axis 1-1 and the plane, the second end 5-2 being close to the intersection. The first ends 5-1 of the cross-sections of the blades are arranged on the circumference of the first circle (having a radius 8 which may be referred to as an "outer diameter") whose center coincides with the intersection on the plane. The second ends 5-2 of the cross-sections of the blades are arranged on the circumference of the second circle (having a radius 7 which may be referred to as an "inner diameter") whose center coincides with the intersection on the plane. The cross-sections of the blades (in S-S section and C-C section) are arranged between the first circle, serving as an outer circumferencial circle, and the second circle, serving as an inner circumferencial circle (FIGS. 2(*b*) and (*c*)).

The inner diameter 7 and the outer diameter 8 depending on the blades in the region S (S-S section) and the region C (C-C section) will be compared. As illustrated in FIGS. 2(*b*) and (*c*), the inner diameter (radius 7*c*) in the blade central part is shorter than the inner diameter (radius 7*s*) in the ring-proximate part (radius 7*s*>radius 7*c*). Furthermore, the outer diameter of the set is constant (radius 8*s*=radius 8*c*). The short radius of the inner circumferencial circle (second circle) means that the cross-sectional shape (corresponding to the chord length) of the blade is long. In other words, the chord length in the region C is longer than that in the regions S. This relationship is illustrated using the radius 7*s* and the radius 7*c* in FIG. 2(*c*). The relationship will also be described later with reference to FIG. 3.

(Appearance Unit)

As illustrated in FIG. 2(*a*) to (*c*), when the set (unit) is sequentially cut in a direction from the ring 2-1 to the other ring 2-2 along the plane whose normal coincides with the rotation axis 1-1, the regions S (first radius regions) and the region C (second radius region) appear such that the radius 7 of the second circle, serving as the inner circumferencial circle, in the regions S is a first radius 7*s* of predetermined length and the radius 7 in the region C is the second radius 7*c* shorter than the first radius 7*s*. The set in which the first radius regions and the second radius region appear as described above will be referred to as an "appearance unit". As illustrated in FIG. 1(*a*), the cross flow fan 1 includes five sets. Each of the five sets may be an appearance unit. Alternatively, at least one of the five sets may be an appearance unit. When the appearance unit of FIG. 2(*a*) is sequentially cut in the direction from the ring 2-1 to the other ring 2-2 along the plane whose normal coincides with the rotation axis 1-1, the regions S (first radius regions) appear at both ends of the appearance unit proximate to the rings 2-1 and 2-2 and the region C (second radius region) appears between the two regions S.

Figure 3:
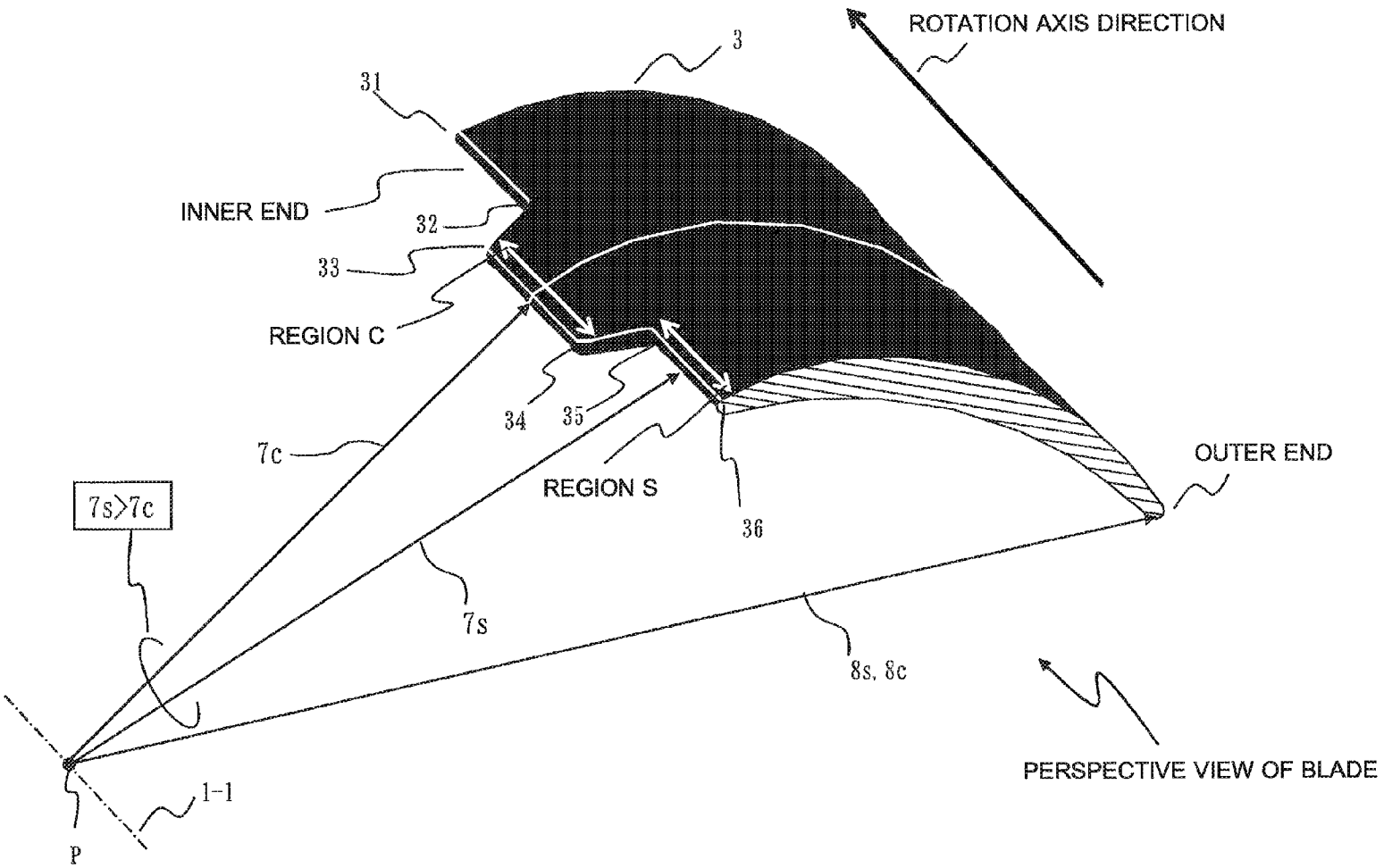
FIG. 3 is a perspective view of a blade of the cross flow fan 1 according to Embodiment 1.

FIG. 3 is a perspective view of the blade 3 attached to the appearance unit. FIG. 3 illustrates one blade. The blade 3 is shaped such that its inner end protrudes while varying from points 31 to 36 along the rotation axis 1-1. The regions S (corresponding to part between the points 31 and 32 and part between the points 35 and 36) are connected to the region C (corresponding to part between the points 33 and 34) such that shoulders are provided.

(Air-Conditioning Apparatus)

Figure 4:
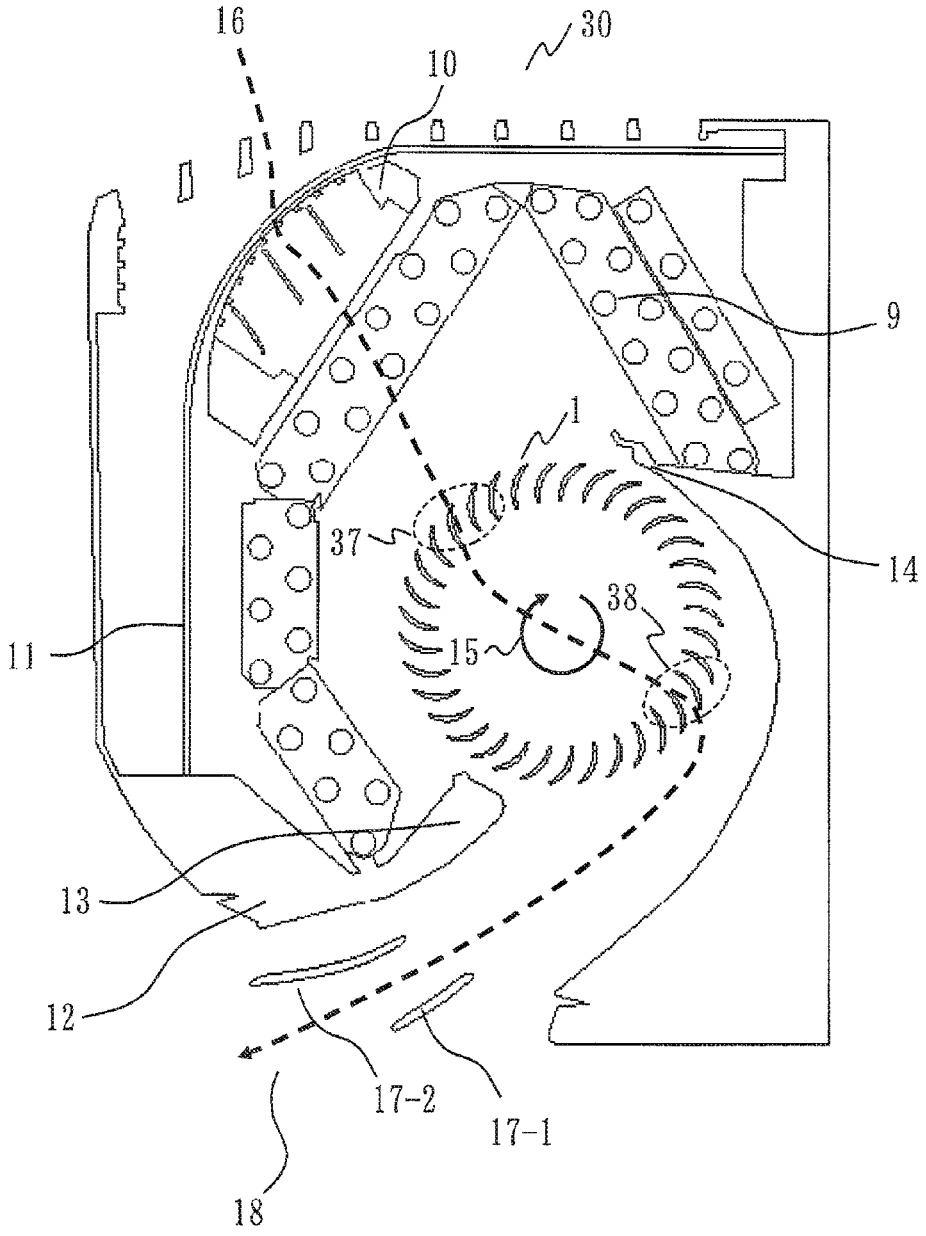
FIG. 4 is a cross-sectional view of an air-conditioning apparatus 30 including the cross flow fan 1 according to Embodiment 1.

FIG. 4 illustrates an exemplary configuration of an air-conditioning apparatus 30 including the cross flow fan 1. A heat exchanger 9 to exchange heat between air and a refrigerant is disposed so as to surround the cross flow fan 1 according to Embodiment 1. In some models, a dust removal or air-cleaning device 10 and a filter 11 are arranged between the heat exchanger 9 and an air outlet 18. A stabilizer 13 attached to an end of a nozzle 12 adjacent to a front side of the unit and a rear guide 14 adjacent to a rear side thereof separates an air inlet side of the cross flow fan 1 from an air outlet side thereof. Rotation (in a rotation direction 15) of the cross flow fan 1 allows an air flow 16 entered from an air inlet to pass through the filter 11, pass through the heat exchanger 9 while exchanging heat, after that, be sucked into an air-sending device (in a range 37), and be then blown from the side (in a range 38) opposite the air inlet side. The air flow passed through an air passage is discharged in a direction defined by air flow control vanes 17 from the apparatus through the air outlet 18.

(Operation)

An operation will now be described. The air flow 16 entered through the air inlet of the air-sending device is sucked into a cascade of blades of the cross flow fan 1, passes inside the fan, and is blown, with respective to the center of the fan, from the cascade of blades (in the range 38) on the opposite side of the air inlet side (in the range 37). The relationship between the outlet part of the cascade of blades of the fan and a direction in which the air flow enters will be described using air flow analyses.

(At Fan Central-Axis Level 19)

Figure 5:
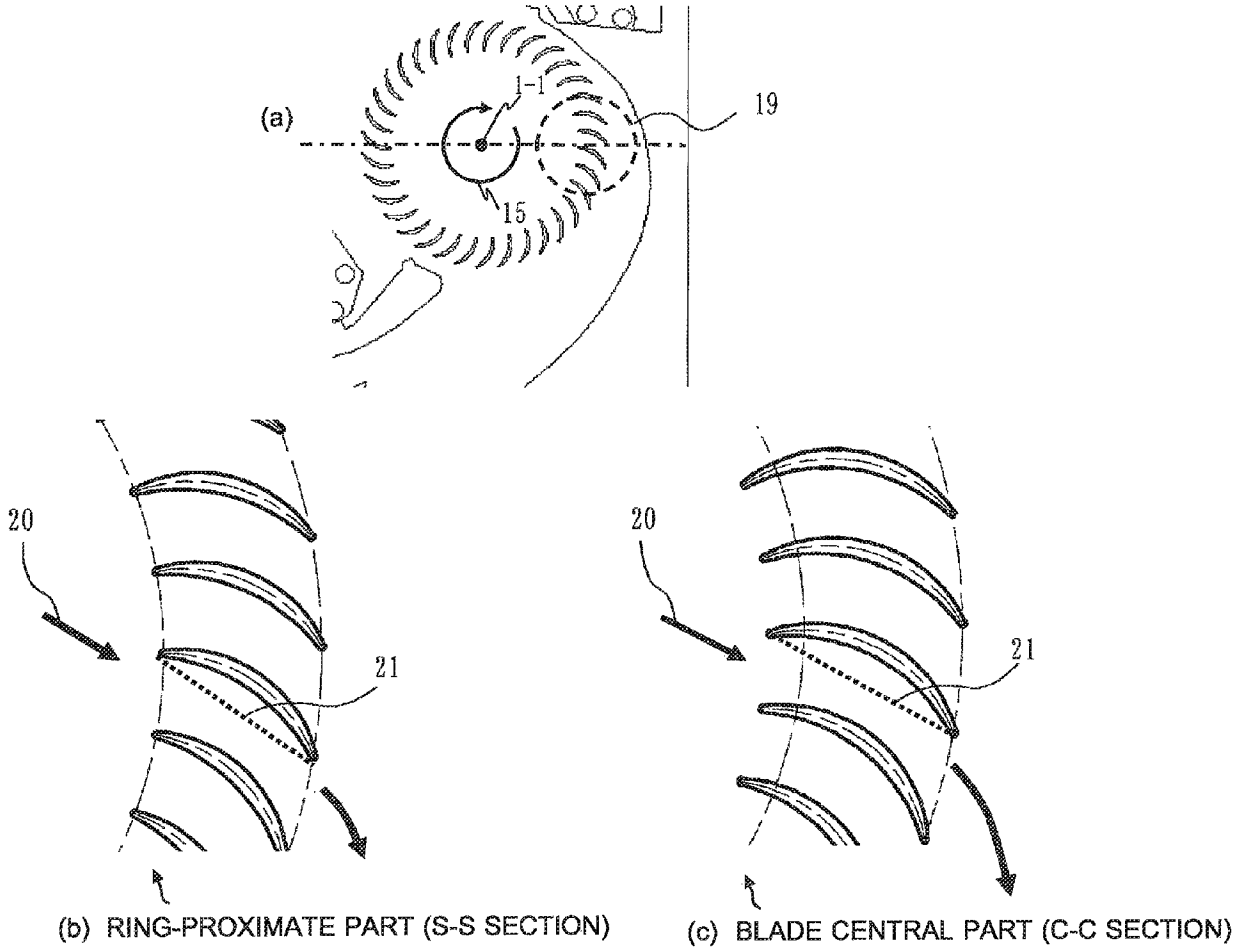
FIG. 5 includes schematic diagrams illustrating the flow of air flowing through the gap between the blades at a level of the central axis of the cross flow fan 1 according to Embodiment 1.

FIG. 5 illustrates a flow field in the vicinity of the cascade of blades at a fan central-axis level 19. FIG. 5(*a*) illustrates the cascade of blades at the fan central-axis level 19. FIG. 5(*b*) illustrates a section (corresponding to the S-S section) of the ring-proximate part at the fan central-axis level 19. FIG. 5(*c*) illustrates a section (corresponding to the C-C section) of the blade central part at the fan central-axis level 19. A direction of air flow 20 flowing into the gap between the blades (or a relative velocity when viewed in the coordinate system of the revolving blades) is substantially parallel to a chord 21 (connecting an inner edge and an outer edge of each blade). Since ventilation resistance of the cascade of blades is dominated by friction, the difference in ventilation resistance between the above parts in the cascade of blades is small. Blades having a long chord provide a large amount of energy to blown air. Accordingly, the blade central part (region C) in which the chord is long allows the velocity of blown air to increase. In other words, the blown air velocity in such a region of long chord blade is higher at the fan central-axis level 19.

(In Lower Unit Part 22)

Figure 6:
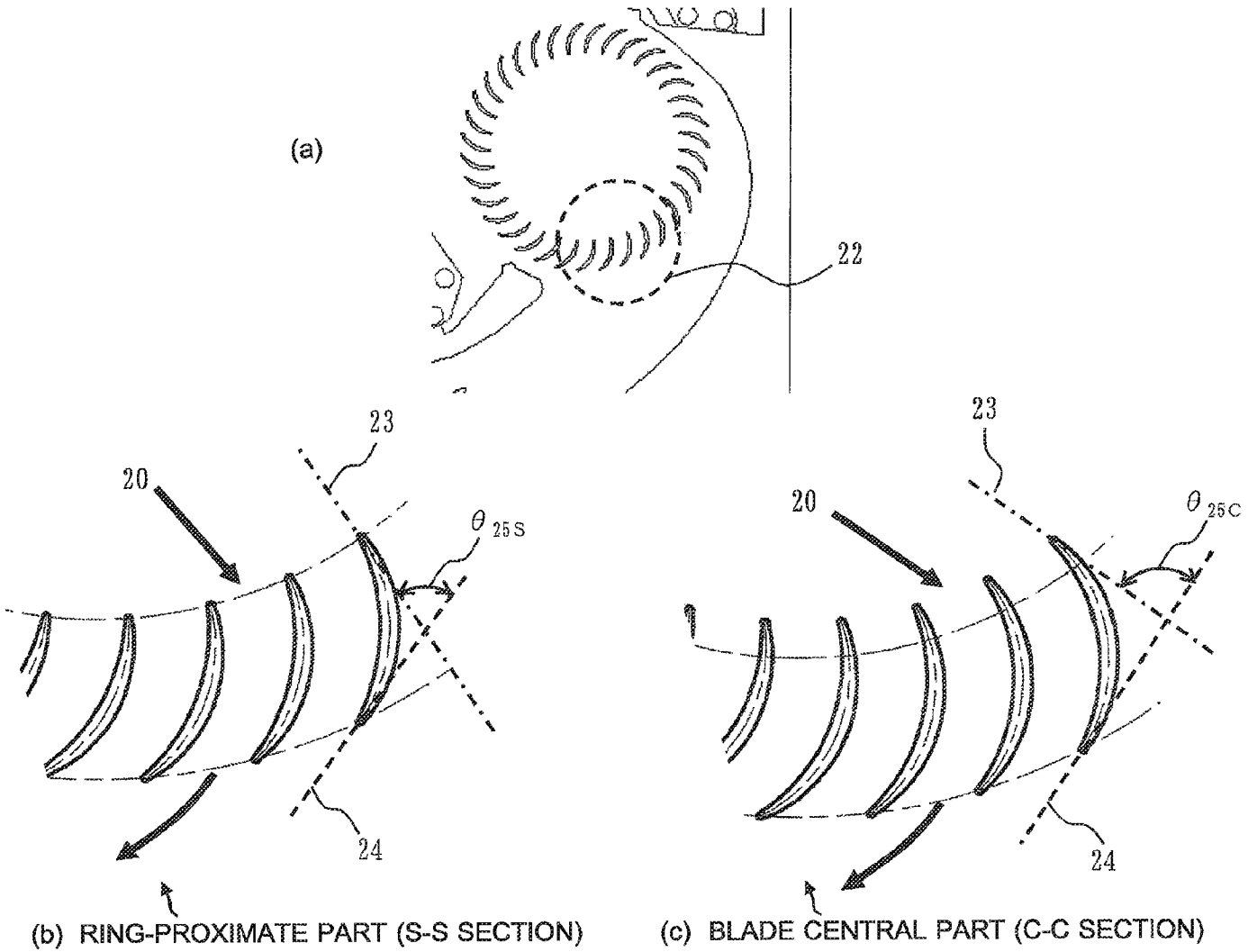
FIG. 6 includes schematic diagrams illustrating the flow of air flowing through the gap between the blades in lower unit part of the cross flow fan 1 according to Embodiment 1.

FIG. 6 illustrates a flow field in the vicinity of the cascade of blades, moved by rotating, in lower unit part 22. FIG. 6(*a*) illustrates the cascade of blades in the lower unit part 22. FIG. 6(*b*) illustrates a section (corresponding to the S-S section) of the ring-proximate part in the lower unit part 22. FIG. 6(*c*) illustrates a section (corresponding to the C-C section) of the blade central part in the lower unit part 22. When the cascade of blades rotates and moves to the lower unit part 22, an angle $\theta_{25}$ formed by an inlet direction 23 and an outlet direction 24 (which are defined by a tangent to the blade center line at an inlet edge of the blade and a tangent to the blade center line at an outlet edge thereof) in the blade central part (FIG. 6(*c*)) is larger than that in the ring-proximate part (FIG. 6(*b*)) ($\theta_{25S}<\theta_{25C}$. Consequently, the degree of deflection of the air is increased when an air flow flowing as with the direction of air flow 20 flows into and out of the gap between the blades during passing therethrough. As the angle $\theta_{25}$ is larger, the ventilation resistance is higher. Thus, the velocity of air blown from the short-chord cascade of blades having a smaller angle $\theta_{25}$ and exhibiting lower resistance is increased.

Figure 7:
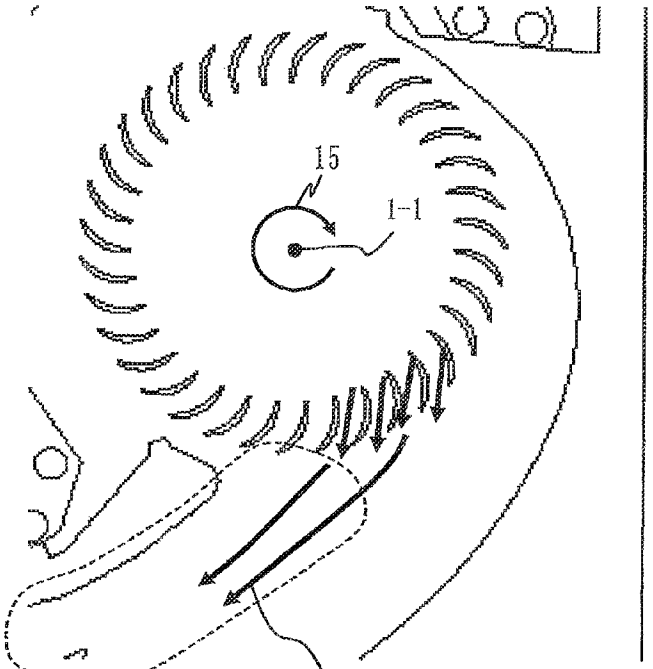
FIG. 7 includes schematic diagrams illustrating the flow of air blown from the cross flow fan 1 according to Embodiment 1.
Figure 7:
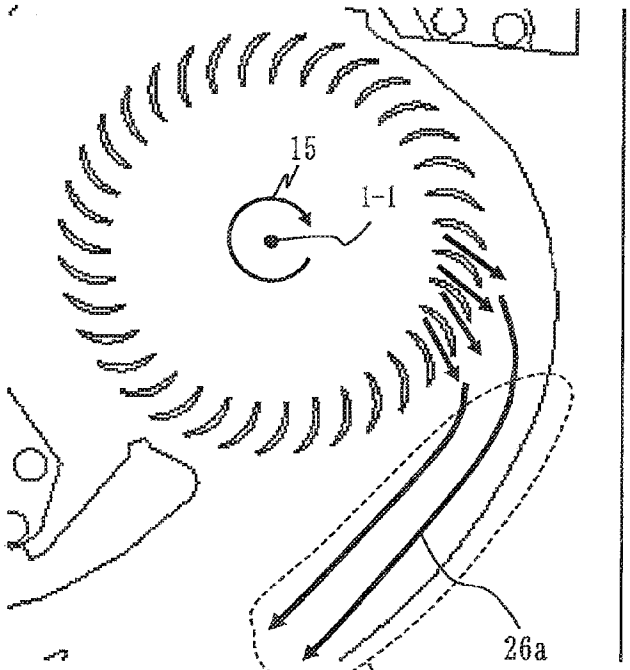

FIG. 7 illustrates a path of air blown from the cascade of blades at the fan central-axis level 19 (FIG. 7(*a*)) in the cross flow fan 1 and a path of air blown from the cascade of blades in the lower unit part 22 (FIG. 7(*b*)). FIG. 7(*a*) illustrates an air flow in the region C (region of long chord blade) at the fan central-axis level 19. Although less air is blown from the cascade of blades at the fan central-axis level 19 as will be described later with reference to FIG. 8(*a*), the effect of the long chord in the region C as illustrated in FIG. 5(*b*) enables an air flow 26*a* to be blown from the gaps between the blades at the fan central-axis level 19, so that the air 26*a* flows in lower air passage part 41. FIG. 7(*b*) illustrates an air flow in the region S (region of short chord blade) in the lower unit part 22. Although less air is blown from the cascade of blades in the lower unit part 22 as will be described later with reference to FIG. 8(*a*), the effect described with reference to FIG. 6(*a*) enables an air flow 26*b* to be blown from the gaps between the blades in the lower unit part 22, so that the air 26*b* flows in upper air passage part 42. An intermediate state between the above-described two phenomena occurs in an area between the fan central-axis level 19 and the lower unit part 22. Accordingly, air flow components are evenly provided between the top and bottom of the air passage, thus forming the flow of blown air that is uniform along the height of the air passage. Furthermore, since air flow components are evenly provided by the blade central part and the ring-proximate parts, the blown air flow is dispersed in the width direction of the fan. As described above, the cross flow fan 1 according to Embodiment 1 enables the blown air flow to be dispersed in the circumferential direction and the width direction.

Figure 8:
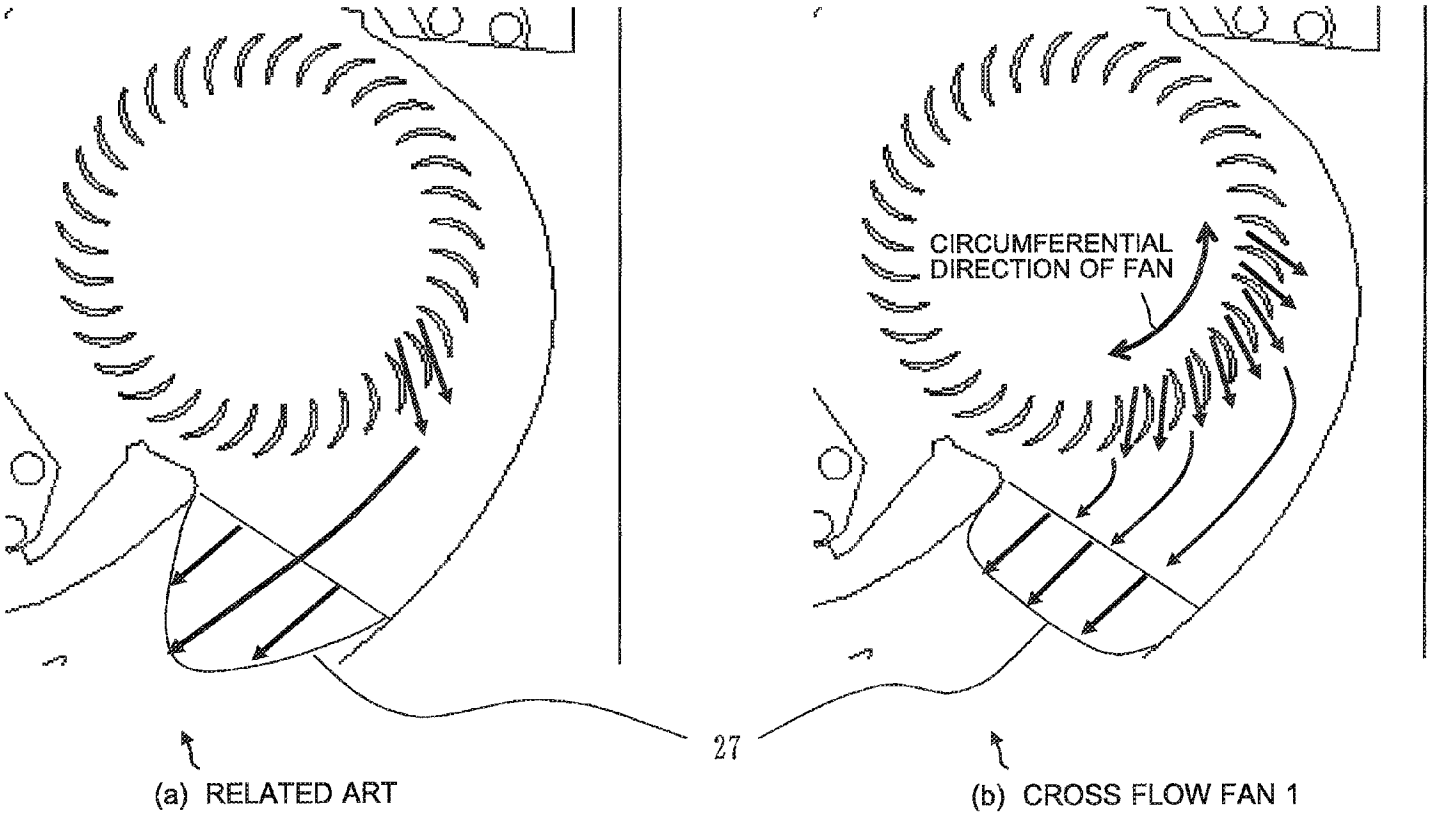
FIG. 8 includes a schematic diagram illustrating the velocity distribution of air blown from a related-art fan and a schematic diagram illustrating the velocity distribution of air blown from the cross flow fan 1 according to Embodiment 1.

FIG. 8(*a*) illustrates a state of air blown from a related-art fan. In the related-art fan, the state of blown air is uniformed in cross-sections. FIG. 8(*b*) illustrates a blown air state that corresponds to a combination of blown air states of each cross-section in the appearance unit of the cross flow fan 1. In the related-art fan of FIG. 8(*a*), the blown air flow is concentrated to the gap between the local blades. In other words, less air flow is provided at the fan central-axis level 19 and in the lower unit part 22 in the related-art fan. As illustrated in FIG. 8(*a*), air is locally blown downward to the right at an angle of 45 degrees. On the other hand, the cross flow fan 1 according to Embodiment 1 enables the blown air flow to be dispersed in the circumferential direction of the fan, as illustrated in FIG. 8(*b*), without being concentrated to the gap between the local blades, thus increasing a blowing range. In comparison at the same air flow rate, as the blowing range is wider, a maximum velocity of air passing through the cascade of blades is lower. This leads to reduced energy loss and noise during passing through the cascade of blades. In addition, a local high velocity area is eliminated in the air passage on a downstream side of the fan, thus uniformizing air velocity distribution 27. Consequently, the maximum velocity of air passing through the air passage or air flow control vanes is reduced, leading to reduced pressure loss. Thus, energy loss can be prevented. Since the maximum air velocity is reduced, noise generated in the air passage is also reduced. In the cross flow fan 1 according to Embodiment 1, since the shape of the inner edge of each blade is varied in order to control the air flow distribution, flow separation at the outer edge of each blade on the air inlet side of the fan is not caused. Advantageously, the cross flow fan 1 can control air flow without increasing noise on the air inlet side.

In the cross flow fan 1 according to Embodiment 1, the variation (leading to different inner diameters) in shape of each blade of the impeller unit (between the two rings) is made clear to provide different shaped blade ranges each having a given width, thus enabling dispersion of blown air flow. Gradual variation in shape of each blade as disclosed in Patent Literature 4 described in Background Art reduces the difference in ventilation resistance in the outlet part of the cascade of blades. Accordingly, air flow may be locally concentrated to the cascade of blades. Disadvantageously, it is difficult to disperse blown air flow in the circumferential direction. In the cross flow fan 1 according to Embodiment 1, in the axial direction, the width of each of the blades that does not change in shape is greater than or equal to one quarter the width of the blade length in one impeller set in order to provide the effect of blown air flow dispersion.

Figure 9:
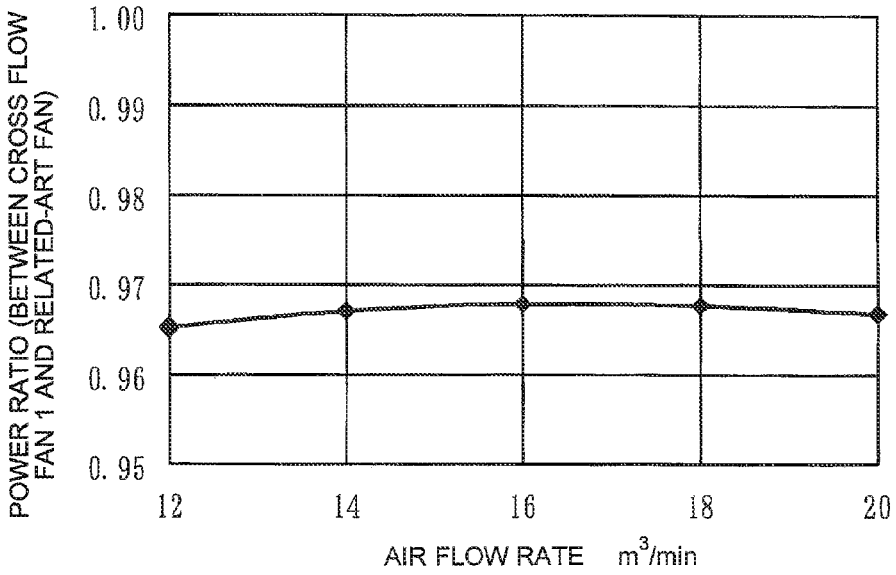
FIG. 9 includes graphs illustrating results of experiments on an air-sending device including the cross flow fan 1 according to Embodiment 1.
Figure 9:
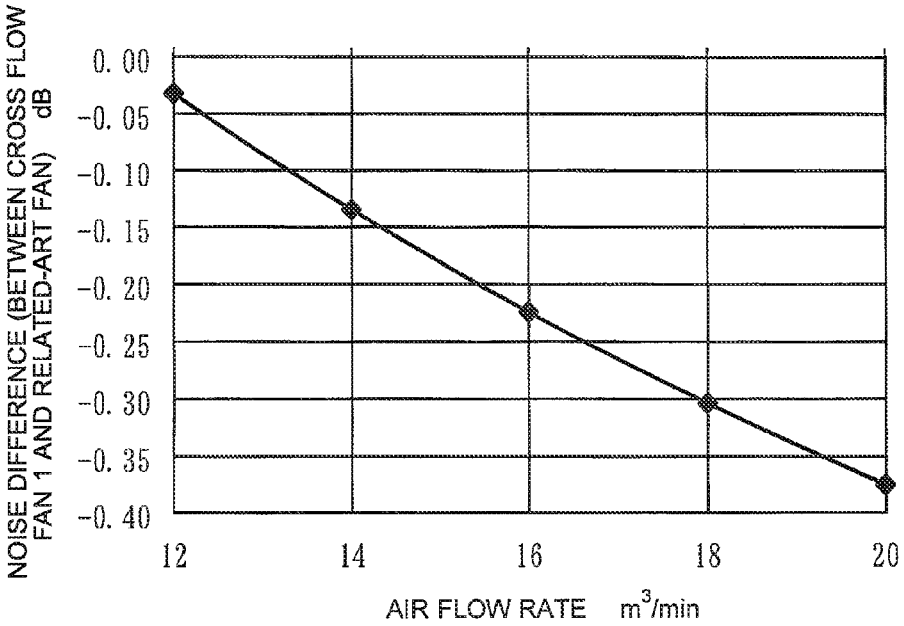

FIG. 9 includes graphs illustrating comparison results between the cross flow fan 1 and the related-art fan. Experiments were conducted on an air-sending device including the cross flow fan 1 according to Embodiment 1. As FIG. 9 shows that torque load of the fan was reduced by approximately 3% at a rated flow rate (18 $m^3$/min) of an air-conditioning apparatus and noise was reduced by 0.3 dB in the cross flow fan 1 according to Embodiment 1.

As described above, the cross flow fan 1 according to Embodiment 1 is configured such that the blowing range of the cascade of blades is increased in order to prevent locally high velocity blown air flow. Thus, the energy loss of air passing through the gaps between the blades can be reduced and noise generated between the blades can also be reduced. In addition, since high velocity flow in the air passage can be prevented, an air-sending device or air-conditioning apparatus with reduced energy loss and reduced noise in an air passage can be achieved.

The cross flow fan 1 according to Embodiment 1 described above is configured as follows. The cross flow fan 1 includes a plurality of impeller units (sets) each including a plurality of blades and the rings supporting the blades, the impeller units being coupled together in the rotational axis direction of the impellers. Rotation of the impellers allows the cross flow fan 1 to suck air on one side and blow the air on the other side. In the cross flow fan 1, when the blades (arranged in each set) sandwiched between the rings are divided into regions each having a given width in the rotational axis direction and the central part of the blade is defined as blade central part and each of parts proximate to the rings is defined as ring-proximate part, the inner diameter provided by the blade central part is smaller than that provided by the ring-approximate part. Note that the outer diameters provided by the both of the parts are the same in the impeller unit.

Embodiment 2

Figure 10:
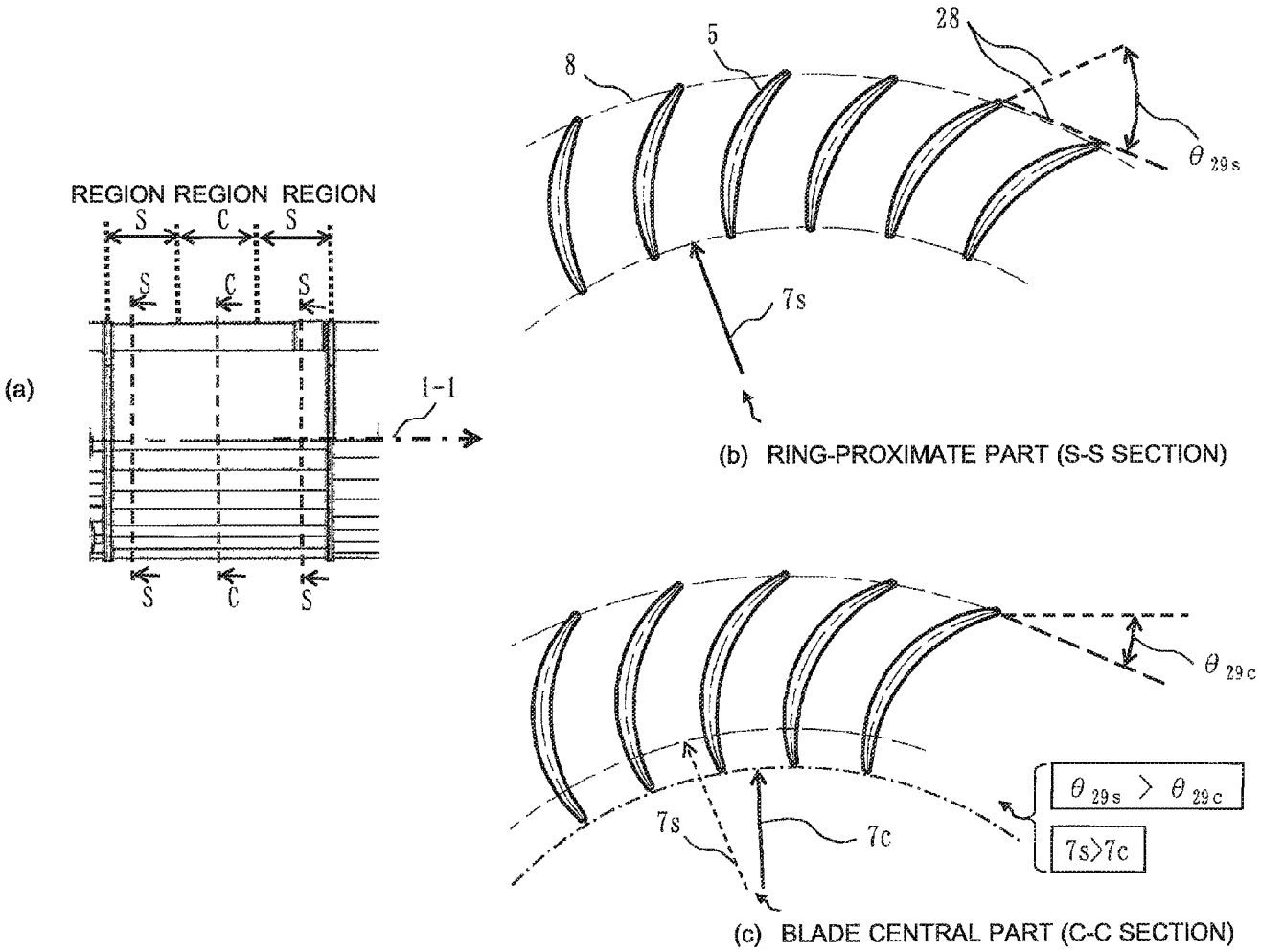
FIG. 10 includes an external view and sectional views of a cross flow fan 1 according to Embodiment 2.

Embodiment 2 will be described below with reference to FIG. 10. FIG. 10 includes views illustrating the shapes of blades of a cross flow fan 1 according to Embodiment 2. Although FIG. 10 is substantially the same as FIG. 2, FIGS. 10(*b*) and (*c*) illustrate an outlet angle. The cross flow fan 1 according to Embodiment 2 has the following features: the outlet angle in a region S (region of short chord blade) is larger than that in a region C (region of long chord blade).

FIGS. 10(*b*) and (*c*) illustrate examples of sections. A section of an impeller corresponding to one set is illustrated as ring-proximate part (S-S section) and blade central part (C-C section), each part having a given width. The central part has a smaller inner diameter (namely, each blade is shaped so as to have a long chord in central part) than the ring-proximate part. This feature is the same as that of Embodiment 1. In the following description, attention will be focused on outer edges of the cross-sections of the blades. As regards an angle (outlet angle $\theta_{29}$) formed by two tangents 28 at the intersection of a blade center line 5 and an arc defined by the outer diameter 8 (or the circumference of a first circle), an outlet angle $\theta_{29s}$ in the ring-proximate part (region of short chord blade) is larger than an outlet angle $\theta_{29c}$ in the blade central part ($\theta_{29s}>\theta_{29c}$.

Increasing the outlet angle $\theta_{29}$ reduces the deflection of air flowing into and out of a cascade of blades when outlet part of the cascade of blades is positioned in lower unit part 22, thus reducing ventilation resistance. Consequently, an area with reduced ventilation resistance in the cascade of blades is increased in the vicinity of the lower unit part, so that a blowing range is increased and the flow rate of blown air is further uniformized. Accordingly, air velocity distribution in an air passage is further uniformized as well, so that a maximum air velocity is further reduced. Advantageously, pressure loss and noise generated in the air passage and air flow control vanes 17 in an air outlet can be reduced. In Embodiment 2, the distribution of blown air is controlled using both the shape of an inner edge of each blade and the shape of an outer edge thereof; therefore, variation in outlet angle may be small. This results in little risk of large flow separation on an air inlet side of the fan.

As described above in Embodiment 2, the cross flow fan 1 is configured such that the outlet angle of each blade in the ring-proximate part is larger than that in the blade central part in cross-section.

Embodiment 3

Figure 11:
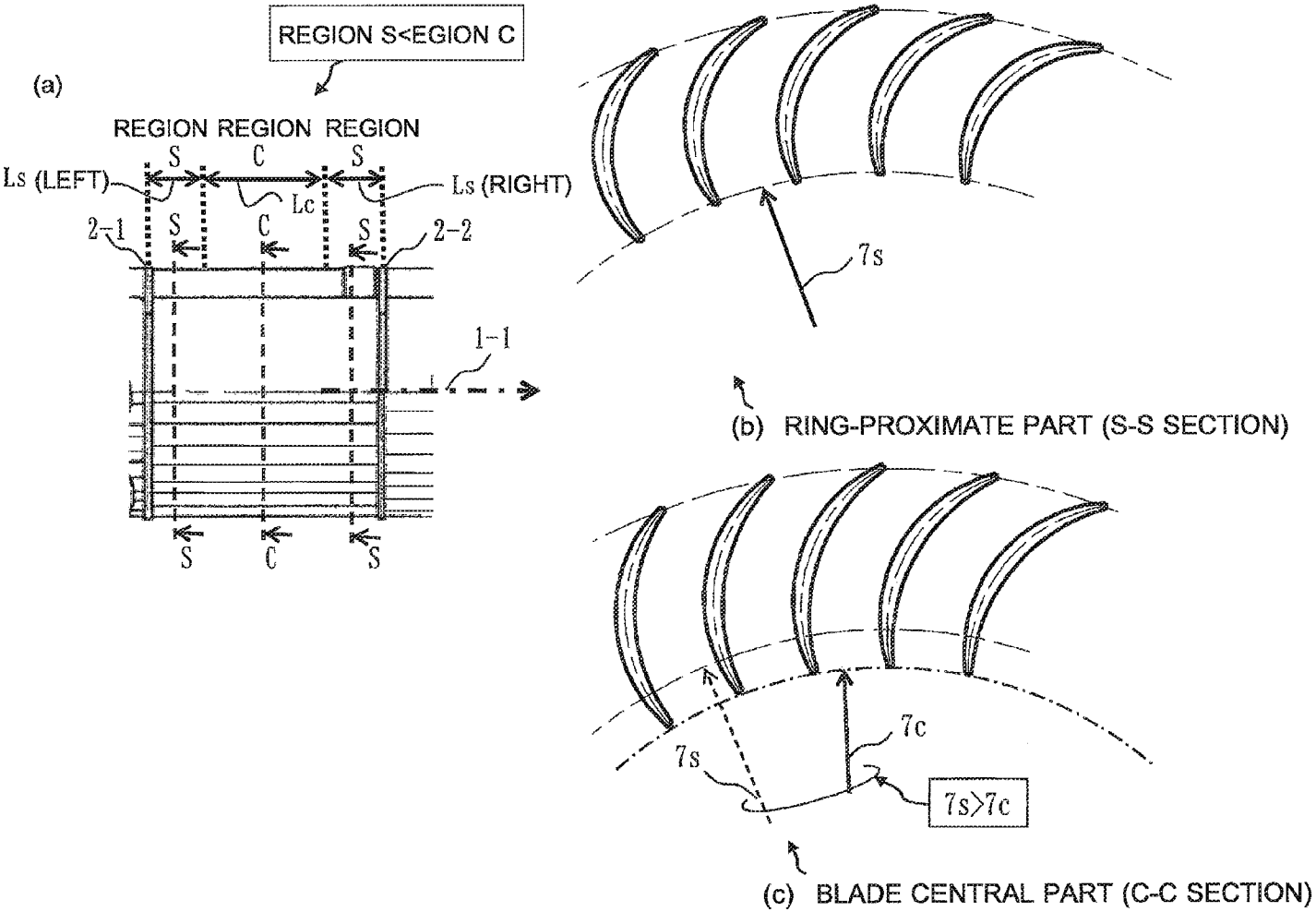
FIG. 11 includes an external view and sectional views of a cross flow fan 1 according to Embodiment 3.

Embodiment 3 will be described below with reference to FIG. 11. FIG. 11 includes views illustrating the shape of each blade of a cross flow fan 1 according to Embodiment 3. FIG. 11 is substantially similar to FIG. 2. In the cross flow fan 1 according to Embodiment 3, the length of a region C (region of long chord blade) in a direction from one ring 2-1 to the other ring 2-2 of an appearance unit is longer than the sum of the lengths of two regions S (region of short chord blades) at both ends of the unit in this direction. In other words, the relationship of Lc>Ls (left)+Ls (right) holds where Ls (left) denotes the length of the left region S in FIG. 11(*a*) in a rotational axis direction, Ls (right) denotes the length of the right region S in the rotational axis direction, and Lc denotes the length of the central region C in the rotational axis direction.

Specifically, a section of an impeller corresponding to one set is illustrated as ring-proximate part (region S) and blade central part (region C), each part having a given width. The blade central part has a smaller inner diameter than the ring-approximate part. This feature is the same as that of Embodiment 1. Embodiment 3 differs from Embodiment 1 in that, in comparison of the proportion between the two shapes of blades in the width direction, the proportion of the blade (region C) having a smaller inner diameter accounts for more than that of the other parts.

As illustrated in FIG. 7, air blown out of the fan at a fan central-axis level 19 flows in lower air passage part 41 along a casing. Since the proportion of the small inner diameter region (region of long chord blade) is large in the cross flow fan 1 according to Embodiment 3, the rate of air flowing in the lower air passage part 41 along the casing is high.

As regards a lower surface (lower air passage part 41) of an air outlet of an air-conditioning apparatus, when the velocity of air passing on this surface is reduced, outside air enters during cooling such that condensation tends to occur on wall surfaces and dew tends to fall downward, resulting in a deterioration of quality. In order to prevent such phenomena, it is only required that the air velocity is increased to prevent the entrance of outside air. Accordingly, the width of each blade having a long chord to provide a smaller inner diameter is increased to increase the flow rate of air blown at the fan central-axis level 19. Note that concentration of air flow to the lower air passage part causes locally high velocity flow and, therefore, causes energy loss and noise increase. According to Embodiment 3, since each blade has short chord parts, blown air is allowed to flow in upper air passage part 42, so that the occurrence of a local high velocity flow area can be prevented and energy loss and noise increase can also be prevented.

As described above in Embodiment 3, the cross flow fan 1 is configured such that, when each of the blades in the impeller unit is divided into a small inner diameter blade region having a given width in the rotational axis direction and large inner diameter blade regions having a given width in the rotational axis direction, the small inner diameter blade region is wider than the large inner diameter blade region.

Embodiment 4

Figure 12:
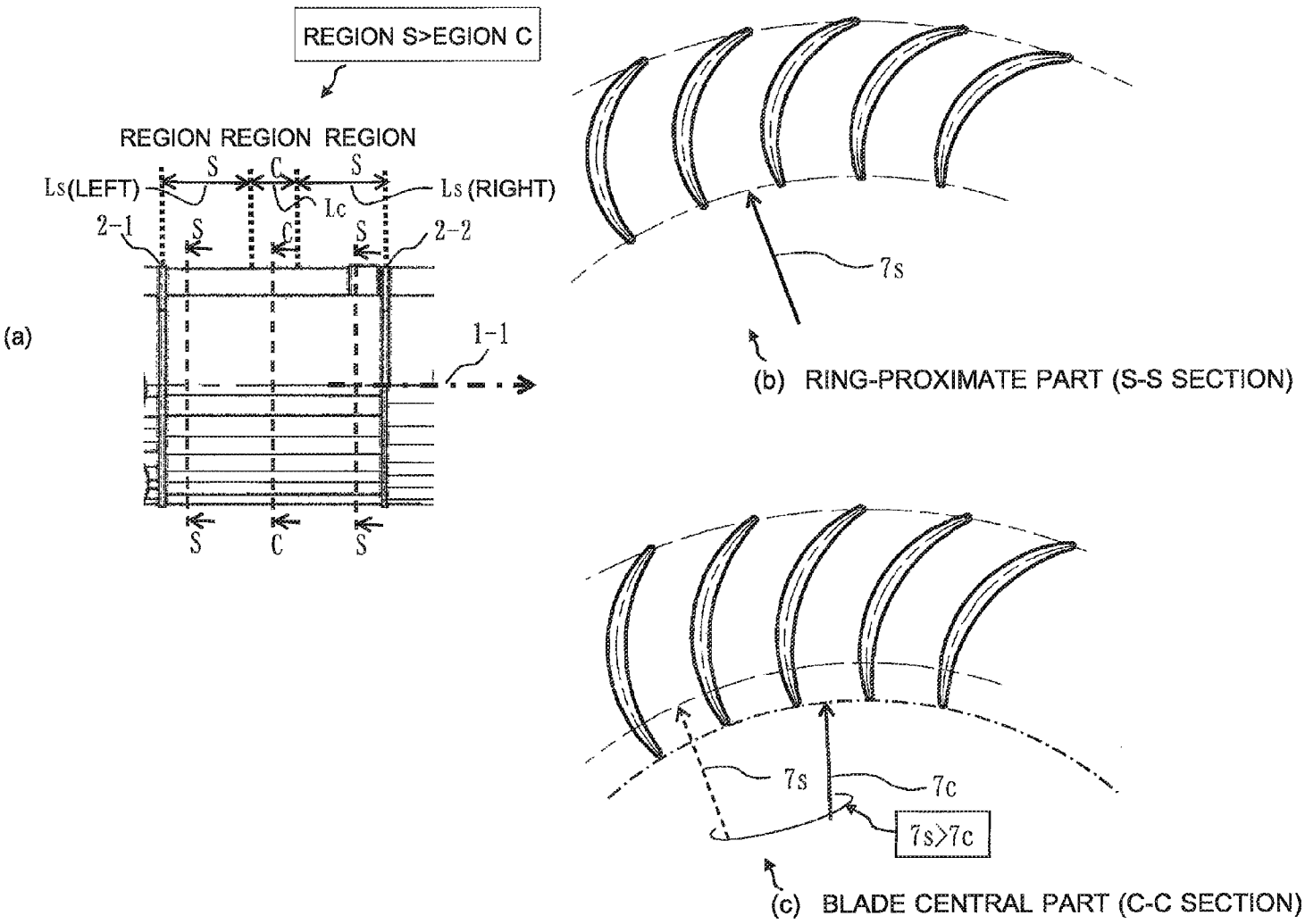
FIG. 12 includes an external view and sectional views of a cross flow fan 1 according to Embodiment 4.

Embodiment 4 will be described below with reference to FIG. 12. FIG. 12 includes views illustrating blade shapes of a cross flow fan 1 according to Embodiment 4. FIG. 12 is substantially similar to FIG. 2. In the cross flow fan 1 according to Embodiment 4, contrary to Embodiment 3, the length of a region C (region of long chord blade) in a direction from one ring 2-1 to the other ring 2-2 of an appearance unit is shorter than the sum of the lengths of two regions S (region of short chord blades) at both ends of the unit in this direction. In other words, the relationship of Ls (left)+Ls (right)>Lc holds where Ls (left) denotes the length of the left region Sin a rotational axis direction, Ls (right) of the right region S in the rotational axis direction, and Lc denotes the length of the central region C in the rotational axis direction in FIG. 12(*a*).

Specifically, as illustrated in FIG. 12, a section of an impeller corresponding to one set is illustrated as ring-proximate part (region S) and blade central part (region C), each part having a given width. The blade central part has a smaller inner diameter than the ring-approximate part. In comparison of the proportion between the two shapes of blades in the width direction, the proportion of the blades having a large inner diameter account for more than that of the other part. Contrary to Embodiment 3, the flow rate of air blown from the fan in lower unit part 22 is high. Consequently, the flow of air blown horizontally by a vane 17-2 in FIG. 4 is increased. Such a blade shape pattern is suitable to increase the range of air flow and to air-condition a large room. Since each blade has long chord part to prevent local concentration of air flow in a manner similar to Embodiment 3, energy loss and noise can be reduced. Consequently, an air-conditioning apparatus that provides a wide range of air flow, low power input, and low noise level can be achieved.

As described above, the cross flow fan 1 is configured such that, when each of the blades in the impeller unit is divided into a small inner diameter blade region having a given width in the rotational axis direction and large inner diameter blade regions having a given width in the rotational axis direction, the large inner diameter blade region is wider than the small inner diameter blade region.

Embodiment 5

Figure 13:
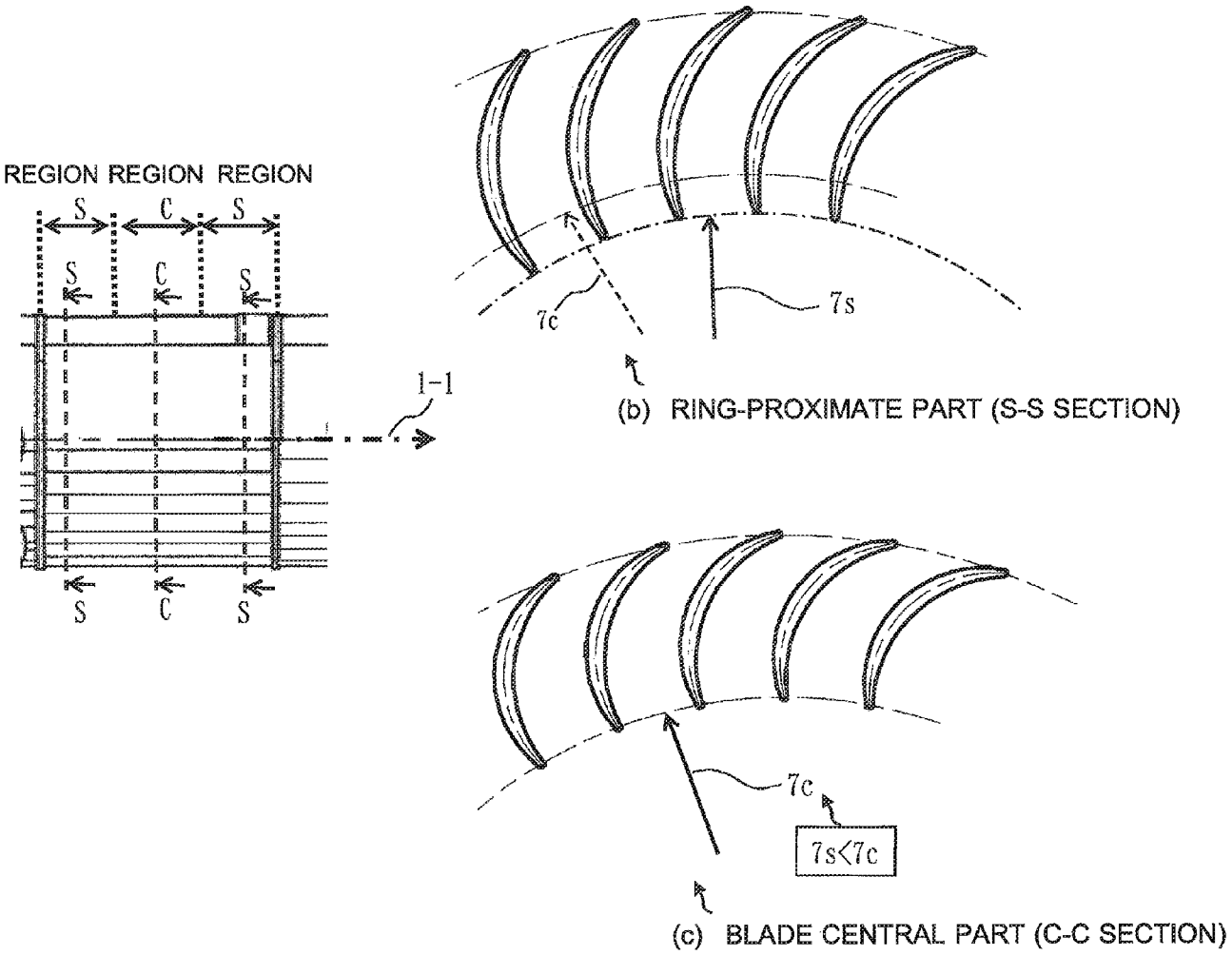
FIG. 13 includes an external view and sectional views of a cross flow fan 1 according to Embodiment 5.
Figure 14:
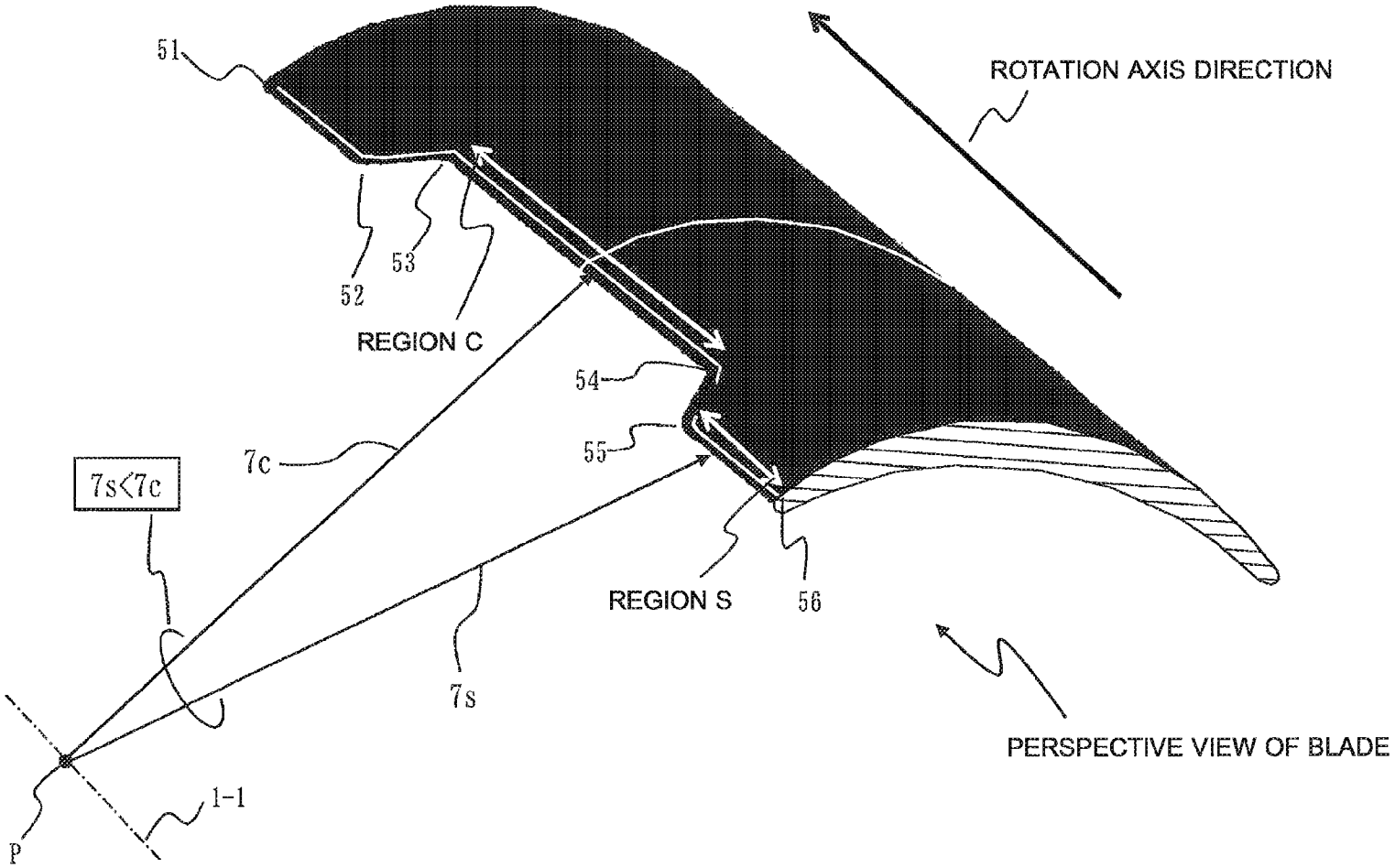
FIG. 14 is a perspective view of a blade of the cross flow fan 1 according to Embodiment 5.

Embodiment 5 will be described with reference to FIGS. 13 and 14. As illustrated in FIG. 14, a cross flow fan 1 according to Embodiment 5 is shaped such that each of two regions S proximate to rings serves as a region of long chord blade and a central region C serves as a region of short chord blade, contrary to Embodiment 1. FIG. 13 corresponds to FIG. 2 and FIG. 14 corresponds to FIG. 3. As illustrated in FIG. 14, when an appearance unit is sequentially cut in a direction from one ring 2-1 to the other ring 2-2 along a plane whose normal coincides with a rotation axis 1-1, a region S (region of long chord blade) having a radius 7*s* appears at each of both ends of the appearance unit proximate to the rings 2-1 and 2-2 in a rotational axis direction of the unit. Furthermore, a region C (region of short chord blade) having a radius 7*c* appears between the two regions S.

FIG. 13 illustrates a section of an impeller corresponding one set as ring-proximate part (region S) and blade central part (region C), each part having a given width. In Embodiments 1 to 4, the blade central part (region C) has a smaller inner diameter than the ring-proximate part (region S). In Embodiment 5, the ring-proximate part has a smaller inner diameter 7*s* than blade central part 7*c* (radius 7*s*<radius 7*c*). FIG. 14 is a perspective view of one blade. The blade has a recessed end defined by points 51 to 56. The regions S are connected to the region C such that shoulders are provided.

In the cross flow fan 1 according to Embodiment 5, the velocity of air flow on a downstream side of the ring-proximate part is increased at a fan central-axis level 19 and the velocity of air flow on a downstream side of the blade central part (region of short chord blade) is increased in lower unit part 22. Accordingly, such a pattern is opposite to that in the above-described cases. The feature of increasing the blowing range of the cascade of blades of the fan to prevent locally high velocity flow is, however, the same as that in the above-described cases. Accordingly, in terms of aerodynamic performance, a low-input low-noise level unit can be achieved in a manner similar to the above-described cases. Meanwhile, in terms of structure, since the ring-proximate parts include heavy blades (long chord blades), deformation of the blades between the rings is reduced. This results in less vibration during high-speed rotation of the fan than those in the above-described cases. In the cross flow fan 1 according to Embodiment 5, therefore, not only air flow noise but also vibration noise can be reduced. Advantageously, an air-sending device or air-conditioning apparatus with lower noise can be achieved.

As described above in Embodiment 5, the cross flow fan 1 is configured such that, when each blade disposed between the rings is divided into regions each having a given width in the rotational axis direction and the middle part of the blade is defined as blade central part and both side parts proximate to the rings are defined as ring-proximate parts, the blade central part has an inner diameter larger than that of the ring-proximate part and the outer diameters provided by the both of the parts are the same in the impeller unit.

Embodiment 6

Embodiment 6 is obtained as Embodiment 2 (outlet angle), Embodiment 3 (region S<region C), or Embodiment 4 (region S>region C) is applied to Embodiment 5. The case where the outlet angle of blade having a large inner diameter is larger as illustrated in Embodiment 2 and the case where one of the blade regions having the large and small inner diameters in the width direction is longer than that of the other region as illustrated in Embodiments 3 and 4 do not depend on whether the blade having a long-chord cross-section is the ring-proximate part or the blade central part. Accordingly, if a cross flow fan has a small inner diameter in ring-proximate parts, the same effects can be obtained. The above-described applications are not illustrated. Specifically, as regards a shape in Embodiment 5, the length of a region C (region of short chord blade) in an appearance unit in a direction from one ring to the other ring may be longer than the sum of the lengths of two regions S (region of long chord blades) at both ends of the unit in this direction. Alternatively, the length of the region C (region of short chord blade) in the appearance unit in the direction from the one ring to the other ring may be shorter than the sum of the lengths of the two regions S (region of long chord blades) at both the ends in the direction. Alternatively, the outlet angle in the region of short chord blade may be larger than that in the region of long chord blades in a manner similar to Embodiment 2.

Embodiment 7

Figure 15:
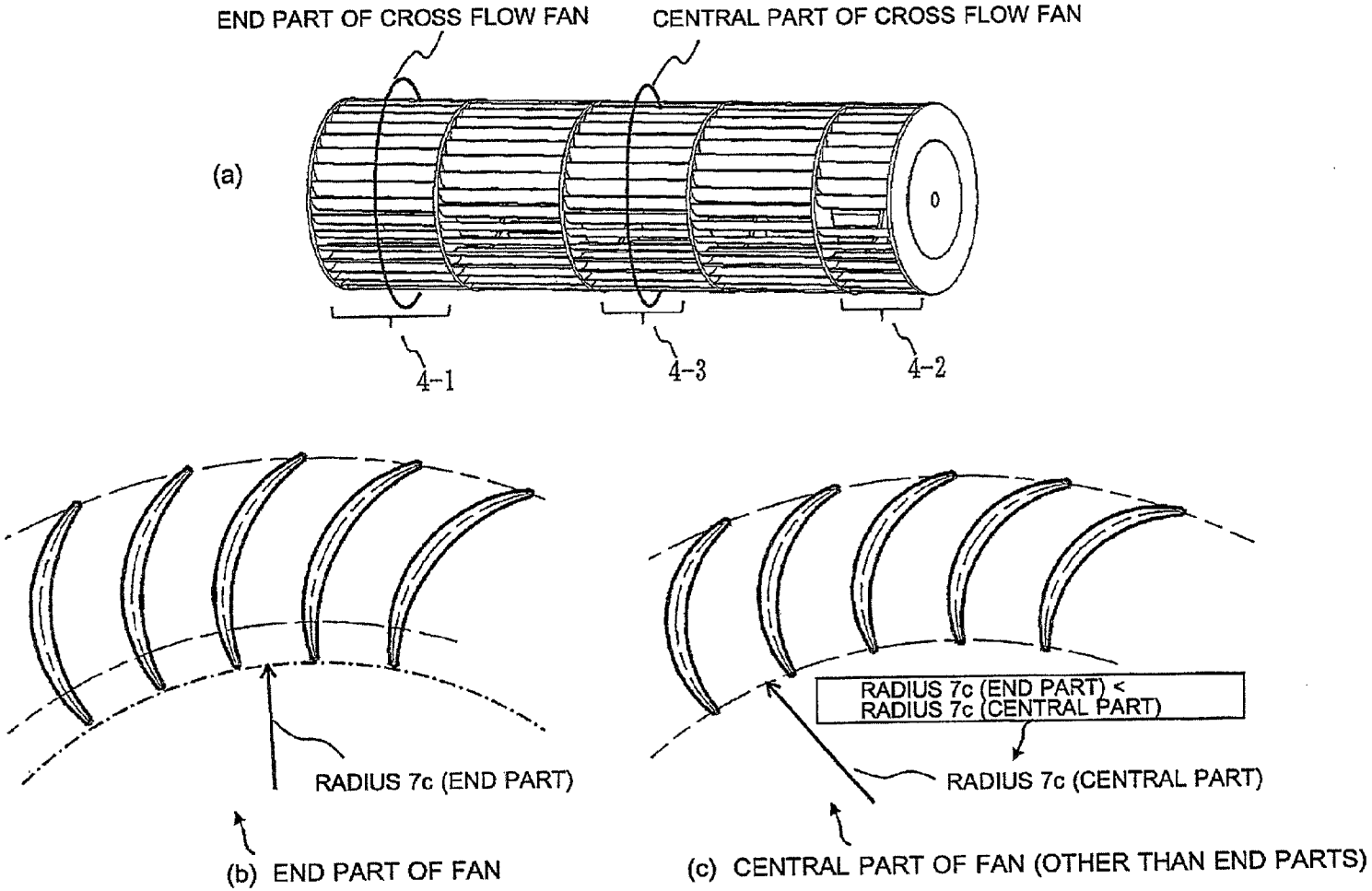
FIG. 15 includes an external view and sectional views of a cross flow fan 1 according to Embodiment 7.

Embodiment 7 will be described below with reference to FIG. 15. FIG. 15(*a*) is a perspective view of a cross flow fan 1 according to Embodiment 7. FIG. 15(*a*) illustrates a case where the cross flow fan 1 includes five sets. It is assumed that each of the sets is an appearance unit in FIG. 15(*a*). Each set has the same shape as that of the appearance unit described in Embodiment 1. Specifically, each blade of the five sets is shaped such that the inner diameter in the blade central part (region C) is smaller than that in the ring-proximate part (region S). In other words, the region C is a region of long chord blade. Embodiment 7 has a feature in that a set 4-1 and a set 4-2 at both ends of the cross flow fan 1 have a smaller inner diameter than the other sets. Specifically, although each of blades of the sets 4-1 to 4-5 has a shape similar to that illustrated in FIG. 3 in Embodiment 1, the radius 7*c* (relating to end part) in the region of long chord blade of each of the sets 4-1 and 4-2 at the ends is shorter than the radius 7*c* (relating to central part) in the region of long chord blade of each of the sets (for example, a central set 4-3) other than the sets at the ends.

As described above, the cross flow fan 1 according to Embodiment 7 includes at least three appearance units such that the appearance units are arranged at both the ends in a direction along a rotation axis 1-1. The radius in the region of long chord blade of each of the appearance units arranged at the ends is shorter than that of the appearance unit disposed at a position other than the ends.

In cases where the inner diameter is short, namely, the chord is long; air is easily blown downwardly, as illustrated in FIG. 7. A phenomenon in that backflow of outside air from an air outlet into the unit tends to occur, in particular, at the ends of the fan. According to Embodiment 7, the inner diameter of each of the sets at the ends is made smaller than that of the sets of the central part of the fan so that the tendency of air to be blown downwardly is enhanced at the ends of the fan. This configuration allows energy loss and noise to be reduced by uniformized velocity distribution of blown air in the sets of the central part of the fan and allows backflow to be prevented at the ends of the fan, thus increasing quality.

As described above in Embodiment 7, as regards the blades having the smaller inner diameter in the impeller units, the cross flow fan 1 is configured such that the inner diameter in each of the impeller units arranged at both the ends of the cross flow fan is smaller than that of the other impeller units.

Embodiment 8

In Embodiment 8, as regards the sets at the both ends of the cross flow fan 1 of Embodiment 1, the cross flow fan 1 is configured such that the region width of a small inner diameter (or the length of a region of long chord blade in a rotational axis direction) in each of sets at both ends of a cross flow fan 1 is wider than that in a set disposed at a position other than the ends.

As described above, the cross flow fan 1 according to Embodiment 8 includes at least three appearance units such that the appearance units are arranged at both the ends in a direction along a rotation axis 1-1. The length of the region of long chord blade in the direction along the rotation axis 1-1 in each of the appearance units at the ends is longer than that in the appearance unit disposed at a position other than the ends.

This configuration allows air to easily flow in lower air passage part at the ends of the fan, so that backflow at the ends of the fan can be prevented in a manner similar to Embodiment 7.

As described above in Embodiment 8, as regards the region dominated by the blade having the smaller inner diameter in the impeller units, the cross flow fan 1 is configured such that the small inner diameter region in each of the impeller units arranged at the ends of the cross flow fan is wider than that in the other impeller unit.

Embodiment 9

Figure 16:
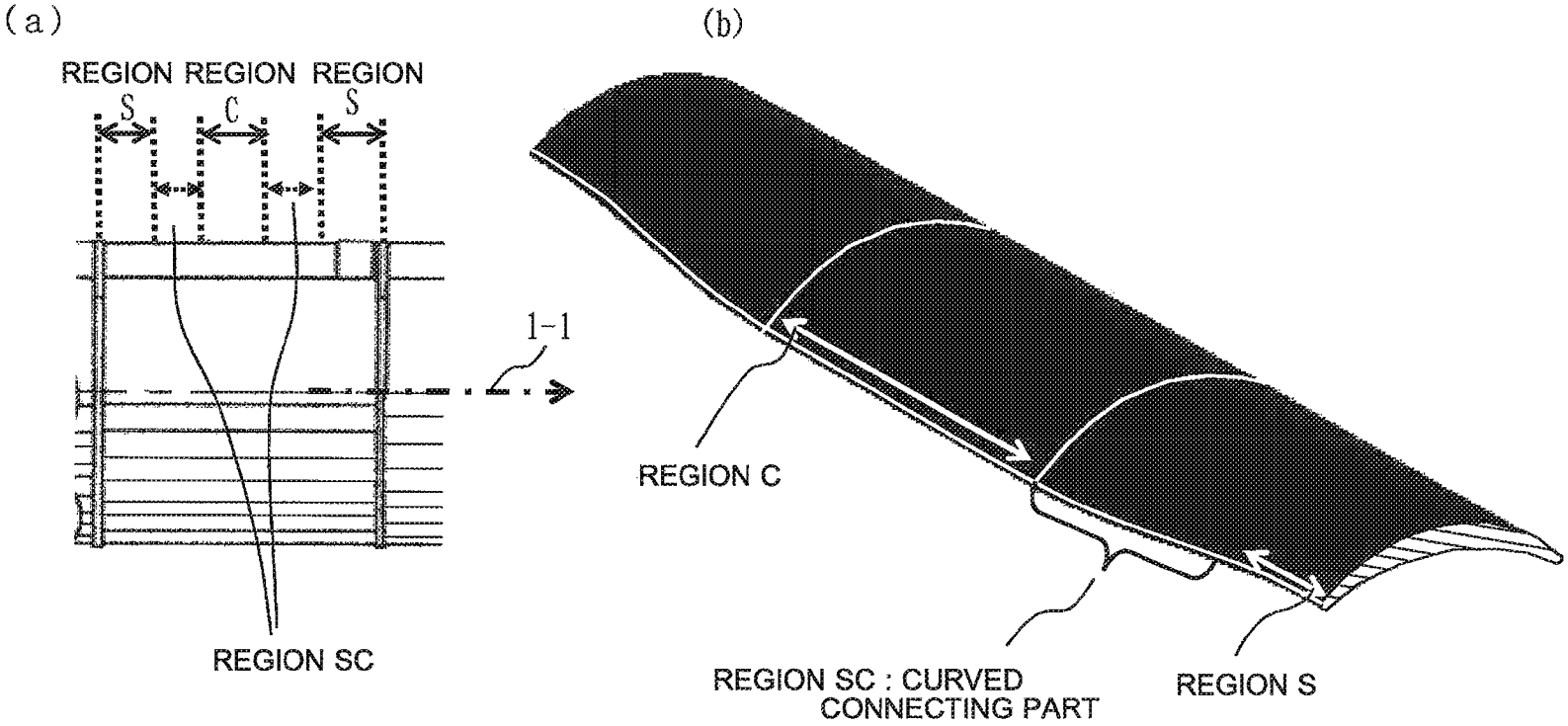
FIG. 16 includes an external view and an overview diagram of a cross flow fan 1 according to Embodiment 9.

FIG. 16 illustrates a perspective view of one blade of a cross flow fan 1 according to Embodiment 9. In the cases in Embodiments 1 to 8, the different shaped blades each having a given width, are arranged in the width direction of one impeller set. Since the blade shape varies, a steep variation in shape may cause wind noise at stepped portions. According to Embodiment 9, the blade is shaped such that part (region SC) having a curved inner end is disposed between each region S and a region C to achieve smooth connection of the regions S and C. Instead of the configuration of thoroughly curved inner end, the region SC may have an inner end as a combination of a straight line and curves, arranged at both ends of the straight line, extending along the shape of the blade. Accordingly, uniform blown air flow can be achieved while preventing wind noise, thus ensuring low noise level and low power input.

As described above, in the cross flow fan 1 according to Embodiment 9, each blade of an appearance unit is shaped such that each region of short chord blade is smoothly connected to a region of long chord blade.

Although Embodiments 1 to 9 have been described with respect to the cross flow fan for an air-sending device or air-conditioning apparatus, the same effects can be obtained with other devices, such as an air cleaner or a dehumidifier, including the cross flow fan. Low noise and low power input can be achieved.

As described in Embodiment 9, the cross flow fan 1 is configured such that each blade of an impeller unit has a small inner diameter region having a given width and a large inner diameter region having a given width, and the two regions are connected by a slope or in curved.

Although Embodiments 1 to 9 have been described with respect to the cross flow fan 1, an air-sending device including the cross flow fan 1 described in any of Embodiments 1 to 9 or an air-conditioning apparatus including this cross flow fan may be implemented as an embodiment.

The invention claimed is:

1. A cross flow fan comprising at least one unit including two ring-shaped blade supporting members arranged at a predetermined distance from each other in an axial direction of a rotation axis of the blade supporting members; and a plurality of blades arranged between the blade supporting members and at outer parts of the blade supporting members and positioned with an interval one another in a circumferential direction of the rotation axis, wherein the blades have first radius regions and a second radius region, the first radius regions each having a first radius that is a radius of an inner circumferential circle connecting inner circumferential ends of the blades in cross-section perpendicular to the axial direction, the first radius regions each extending continuously in the axial direction, the second radius region having a second radius that is a radius of another inner circumferential circle connecting inner circumferential ends of the blades, the second radius region being different from the first radius and extending continuously in the axial direction, wherein the first radius regions are provided at both ends of the blades in the axial direction, wherein the second radius region is provided between the first radius regions, and wherein each length in the axial direction of the first radius regions and a length in the axial direction of the second region are greater than or equal to one quarter of a length in the axial direction of the blades.

2. The cross flow fan of claim 1, wherein the second radius is shorter than the first radius.

3. The cross flow fan of claim 1, wherein the second radius is longer than the first radius.

4. The cross flow fan of claim 1, wherein the length in the axial direction of the second radius region is longer than a sum of each length in the axial direction of the first radius regions.

5. The cross flow fan of claim 1, wherein the length in the axial direction of the second radius region is shorter than a sum of each length in the axial direction of the first radius regions.

6. The cross flow fan of claim 1, wherein the at least one unit is configured to be a plurality of units provided at both ends in the axial direction and therebetween, and wherein one of the radius at the first radius regions and the radius at the second radius region of the units provided at the both ends is shorter than the other, and a radius at the first radius regions or the second radius region having the shorter radius in units provided at the both ends is shorter than a corresponding radius in the unit provided between the both ends.

7. The cross flow fan of claim 1, wherein the at least one unit is configured to be a plurality of units provided at both ends in the axial direction and therebetween, and wherein one of the radius at the first radius regions and the radius at the second radius region of the units provided at the both ends is shorter than the other, and a length in the axial direction of the first radius regions or the second radius region having the shorter radius in the units provided at the both ends is longer than a corresponding length in the unit provided between the both ends.

8. The cross flow fan of claim 1, wherein each of the blades includes a connection region between the first radius regions and the second radius region, and inner circumferential ends of the connection region connects the inner circumferential ends of the first radius regions and the inner circumferential ends of the second radius region without forming a stepped portion.

9. The cross flow fan of claim 1, wherein an inclination of a center line of each of the blades with respect to a tangent to an outer circumferential circle connecting outer circumferential ends of the blades in cross-section perpendicular to the axial direction in the first radius regions or the second radius region having a longer radius in the unit is larger than a corresponding inclination in the first radius regions or the second radius region having a shorter radius in the unit.

10. An air-sending device comprising the cross flow fan of claim 1.

11. An air-conditioning apparatus comprising the cross flow fan of claim 1.

* * * * *